US009950230B2

(12) United States Patent
Silva et al.

(10) Patent No.: US 9,950,230 B2
(45) Date of Patent: Apr. 24, 2018

(54) CHAIR WITH GAME FEATURES

(71) Applicants: Michael Silva, Kendall Park, NJ (US); Frank Silva, Cumming, GA (US)

(72) Inventors: Michael Silva, Kendall Park, NJ (US); Frank Silva, Cumming, GA (US)

( * ) Notice: Subject to any disclaimer, the term of this patent is extended or adjusted under 35 U.S.C. 154(b) by 0 days.

(21) Appl. No.: 15/497,856

(22) Filed: Apr. 26, 2017

(65) Prior Publication Data

US 2018/0028888 A1 Feb. 1, 2018

Related U.S. Application Data

(60) Provisional application No. 62/369,464, filed on Aug. 1, 2016.

(51) Int. Cl.

| | |
|---|---|
| ***A63B 63/00*** | (2006.01) |
| ***A47C 7/62*** | (2006.01) |
| ***A63B 67/06*** | (2006.01) |
| ***A63B 71/00*** | (2006.01) |
| ***A63B 63/08*** | (2006.01) |
| *A47C 7/72* | (2006.01) |

(52) U.S. Cl.

CPC ..... *A63B 67/06* (2013.01); *A63B 63/004* (2013.01); *A63B 63/083* (2013.01); *A63B 71/0036* (2013.01); *A47C 7/62* (2013.01); *A47C 7/72* (2013.01); *A63B 2209/10* (2013.01); *A63B 2210/02* (2013.01); *A63B 2210/50* (2013.01); *A63B 2225/682* (2013.01)

(58) Field of Classification Search

CPC .. A47C 7/62; A47C 7/72; A47C 1/143; A47C 4/40; A63B 63/00; A63B 63/08; A63B 67/06

USPC ..... 273/398–402; 297/217.1, 31, 16.2

See application file for complete search history.

(56) References Cited

U.S. PATENT DOCUMENTS

| | | | | | |
|---|---|---|---|---|---|
| 162,447 | A * | 4/1875 | Wilson | A47C 4/40 | 297/108 |
| 1,348,262 | A * | 8/1920 | Brockway | A63H 3/52 | 108/11 |
| 4,015,778 | A * | 4/1977 | Chen | A47C 4/24 | 273/284 |
| 4,643,433 | A * | 2/1987 | Wehby | A63F 9/0204 | 273/348 |
| 4,955,605 | A * | 9/1990 | Goldfarb | A63B 21/1663 | 193/25 R |
| 5,246,265 | A * | 9/1993 | Nagan | A47C 3/38 | 297/31 |

(Continued)

*Primary Examiner* — Mark Graham

(74) *Attorney, Agent, or Firm* — McCarter & English, LLP

(57) ABSTRACT

The present disclosure relates to a chair with game features. A foldable chair includes a foldable structure having a back canvas structure, a bottom canvas secured to the foldable structure and having a through-hole, a cover flap removably connected to the bottom canvas covering the through-hole, and a back canvas removably secured to the back canvas structure. A field goal includes a plurality of pipes connected with a plurality of connection fittings. The back canvas can be removed so that the field goal can be removably connected to the back canvas structure. The cover flap can be moved from a first position covering the through-hole, and a second position where the through-hole is exposed. In some embodiments a foldable backboard can be removably connected to the back canvas structure.

29 Claims, 10 Drawing Sheets

(56) References Cited

U.S. PATENT DOCUMENTS

| | | | | |
|---|---|---|---|---|
| 5,910,058 | A * | 6/1999 | Zheng | A63B 63/083 473/481 |
| 6,976,733 | B1 * | 12/2005 | Biederman | A47C 4/24 297/160 |
| 7,073,852 | B1 * | 7/2006 | Zheng | A47C 4/286 297/16.2 |
| 7,509,695 | B2 * | 3/2009 | Zheng | A47C 17/68 273/108 |
| 7,823,968 | B2 * | 11/2010 | Long | A47C 4/286 297/184.11 |
| 8,282,509 | B1 * | 10/2012 | Michaelson | A63B 69/36 273/400 |
| 8,528,910 | B2 * | 9/2013 | Escobar | A63B 63/08 273/398 |
| 8,708,406 | B1 * | 4/2014 | Powell | A47C 21/00 297/188.06 |
| 8,764,017 | B2 * | 7/2014 | Manner | A63F 3/00533 273/398 |
| 2007/0045964 | A1 * | 3/2007 | Petras | A63B 63/00 273/317 |
| 2008/0252018 | A1 * | 10/2008 | Chung | A63B 24/0021 273/402 |
| 2009/0115136 | A1 * | 5/2009 | Voden | A63B 21/0053 273/336 |
| 2010/0025934 | A1 * | 2/2010 | Hassman | A63B 63/00 273/400 |
| 2015/0054318 | A1 * | 2/2015 | Howard | A47C 7/40 297/188.04 |
| 2016/0166068 | A1 * | 6/2016 | Holzhauzer | A63B 67/06 297/16.1 |
| 2016/0192783 | A1 * | 7/2016 | Kelly | A47C 7/62 135/96 |

* cited by examiner

CHAIR WITH GAME FEATURES

RELATED APPLICATIONS

The present application claims priority to U.S. Provisional Application No. 62/369,464, filed on Aug. 1, 2016, the disclosure of which is incorporated by reference herein in its entirety.

TECHNICAL FIELD

The present disclosure relates generally to a device that allows for game playing. More specifically, the present disclosure relates to a chair with game features.

BACKGROUND

Outdoor events are an important part of American's culture. In particular, at various sporting events, "tailgate" parties are a popular way of socializing before (and sometimes after) a sporting event. Socializing, sharing food and beverages, and participating in various games are often activities undertaken at tailgate parties. Other forms of outdoor events include outdoor barbecues, lawn parties, and other social events.

At such outdoor events, it is often popular for participants to play sports and games. For example, at tailgate parties before football or other sporting events, attendees at such parties can often be seen participating in games for leisure and entertainment. Often, parents and children participate in such events. Various forms of sports and games are played at outdoor events, such as football, basketball, cornhole, baseball, etc.

Adequate seating is also a very important requirement for outdoor events, and in particular, tailgate parties. Because of this, individuals attending such events must often pack their vehicles with various equipment such as chairs, tables, barbecue equipment, umbrellas, etc., and transport such equipment to the event venue. Since vehicles have limited space, it can be difficult to pack such equipment into the vehicle, and as a result, it may be difficult to find adequate room in the vehicle to transport additional equipment such as equipment for sports and games. Accordingly, what would be desirable is a game playing chair that can function both as a conventional chair on which a person can sit, but which can also function as a game that can be used at an outdoor event.

SUMMARY

The present disclosure relates to a chair with game features. The chair can function as a conventional folding chair used at outdoor events, and can also function as a game that can be played at such outdoor events. By combining multiple features into one compact package, the chair is space-saving and easily transported. The chair is uniquely designed to provide an enhanced tailgating experience, by providing room to rest, and a gameplay area into a combined package.

In some example embodiments, a game playing device includes a foldable chair that includes football game components. The foldable chair includes a foldable structure having a back canvas structure, a bottom canvas secured to the foldable structure, a cover flap removably connected to the bottom canvas, and a back canvas removably secured to the back canvas structure. The bottom canvas has a through-hole, and the cover flap can cover the through-hole. A removably attachable field goal includes a plurality of pipes and a plurality of connection fittings. The plurality of pipes are connected with the plurality of connection fittings to form the field goal. The back canvas can be removed from the back canvas structure and the field goal can be removably connected to the back canvas structure when the back canvas is removed from the back canvas structure. The cover flap can be moved from a first position to a second position. When the cover flap is in the first position it covers the through-hole and allows a user to sit on the foldable chair. When the cover flap is in the second position it is at least partially removed from the bottom canvas in order to expose the through-hole. In some aspects, the game playing device can include a net secured about the perimeter of the through-hole. In other aspects, the game playing device can include a ball configured to be inserted into the through-hole.

In another embodiment of the present disclosure, a kit for a game playing device is provided. The kit includes a foldable chair, football game components, and a carrying case. The foldable chair includes a foldable structure having a back canvas structure, a bottom canvas secured to the foldable structure, a cover flap removably connected to the bottom canvas, and a back canvas removably secured to the back canvas structure. The bottom canvas has a through-hole, and the cover flap can cover the through-hole. The field goal includes a plurality of pipes and a plurality of connection fittings. The plurality of pipes are connectable with the plurality of connection fittings to form the field goal. The back canvas is removable from the back canvas structure and the field goal is removably connectable to the back canvas structure when the back canvas is removed from the back canvas structure. The cover flap is movable from a first position to a second position. When the cover flap is in the first position it covers the through-hole and allows a user to sit on the foldable chair. When the cover flap is in the second position it is at least partially removed from the bottom canvas in order to expose the through-hole. In some aspects, the kit can include a net secured about the perimeter of the through-hole. In other aspects, the kit can include a ball configured to be inserted into the through-hole. In still other aspects, the kit can include a carrying case that is configured to receive the foldable chair and the field goal.

In another example embodiment of the present disclosure, a game playing device includes a foldable chair and a backboard. The foldable chair includes a foldable structure having a back canvas structure, a bottom canvas secured to the foldable structure, a cover flap removably connected to the bottom canvas, and a back canvas removably secured to the back canvas structure. The bottom canvas has a through-hole, and the cover flap can cover the through-hole. The back canvas can be removed from the back canvas structure and the backboard can be removably connected to the back canvas structure when the back canvas is removed from the back canvas structure. The cover flap can be moved from a first position to a second position. When the cover flap is in the first position it covers the through-hole and allows a user to sit on the foldable chair. When the cover flap is in the second position it is at least partially removed from the bottom canvas in order to expose the through-hole. In some aspects, the game playing device can include a net secured about the perimeter of the through-hole. In other aspects, the game playing device can include a ball configured to be inserted into the through-hole.

In another example embodiment of the present disclosure, a game playing device includes a foldable chair, a game mat, and a pole. The foldable chair includes a foldable structure having a back canvas structure, a bottom canvas secured to the foldable structure, a cover flap removably connected to the bottom canvas, and a back canvas removably secured to the back canvas structure. The foldable chair can be positioned on the game mat. The cover flap can be moved from a first position to a second position. When the cover flap is in the first position it covers the through-hole and allows a user to sit on the foldable chair. When the cover flap is in the second position it is at least partially removed from the bottom canvas in order to expose the through-hole and permit the pole to be inserted into the through-hole and secured to the game mat.

DETAILED DESCRIPTION OF THE INVENTION

The present disclosure relates to a chair with game features, as described in detail below in connection with FIGS. 1-11.

Figure 1:
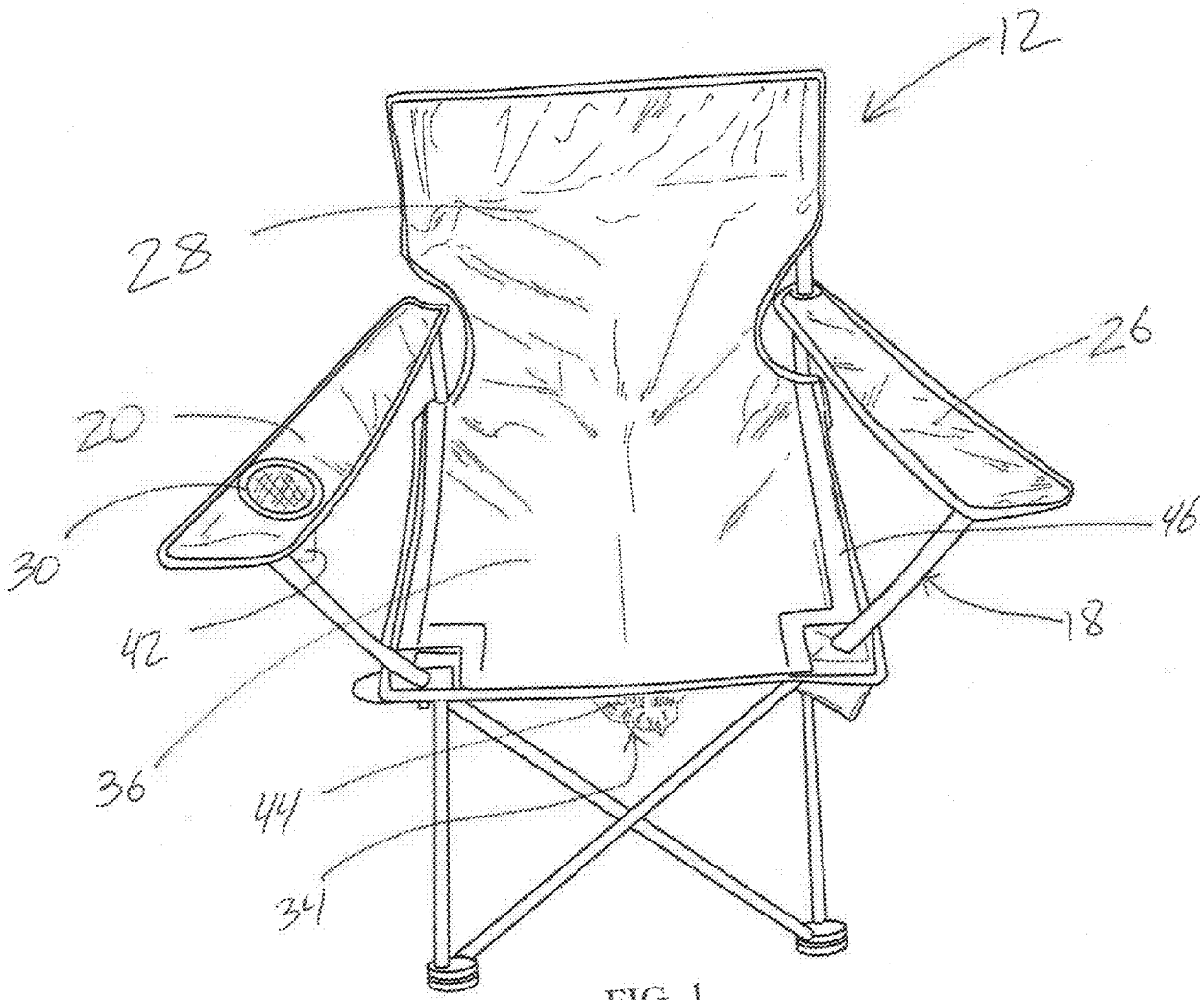
FIG. 1 is a front view of the device of the present disclosure.
Figure 2:
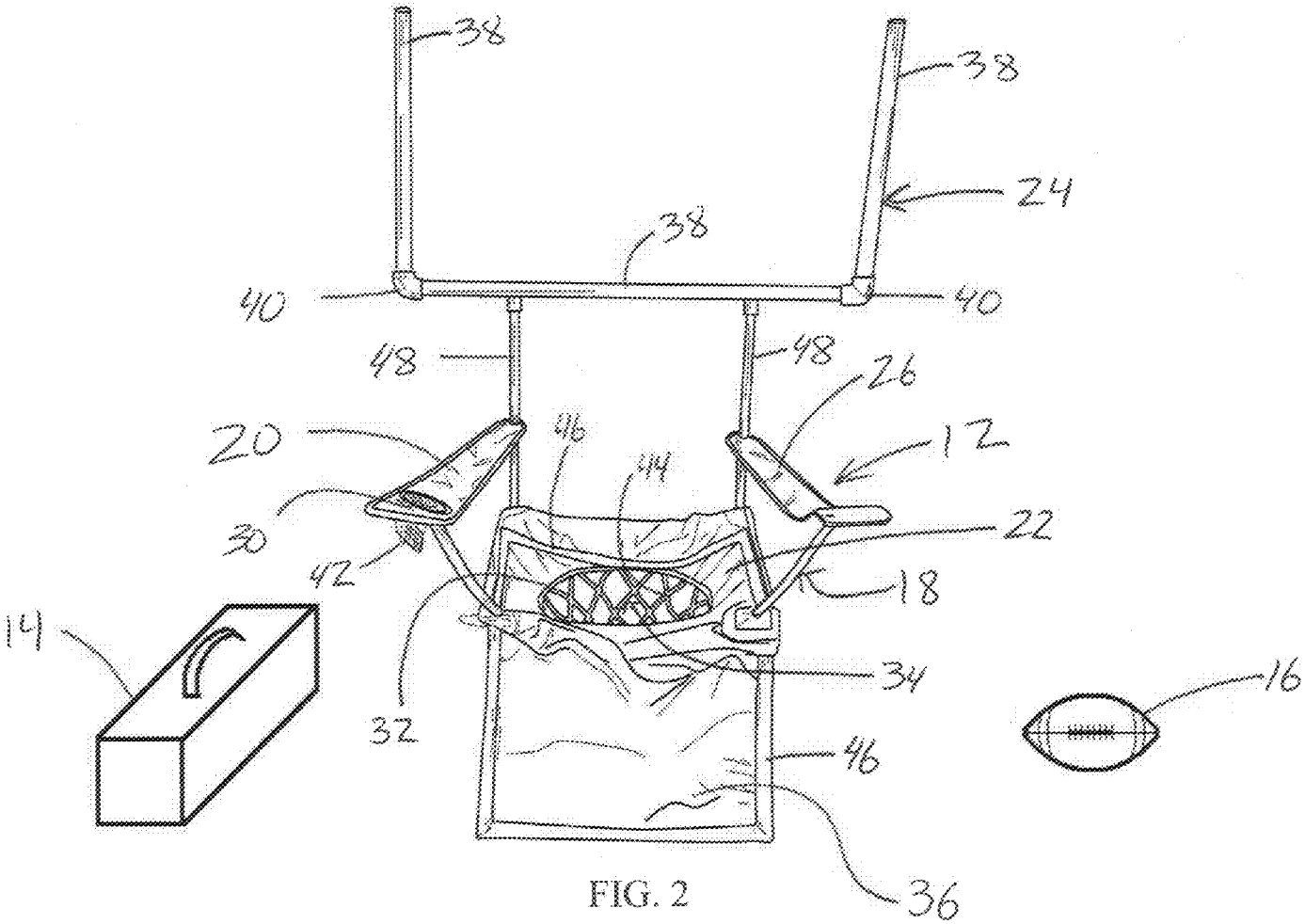
FIG. 2 is a front view of the device of the present disclosure, which illustrates game features of the device.

In reference to FIGS. 1 and 2, a game playing device 10 is shown which includes a foldable chair 12, a carrying case 14, and a ball 16. The foldable chair 12 includes a foldable structure 18, a first armrest 20, a bottom canvas 22, a field goal post 24 (see FIG. 2), a second armrest 26, and a back canvas 28. The first armrest 20 includes a cup holder 30. Additionally, the bottom canvas 22 comprises a through hole 32, a basketball net 34, and a cover flap 36. The field goal 24 post comprises a plurality of tubes 38 and a plurality of connection fittings 40. The cup holder 30 comprises a mesh 42, and the basketball net 34 comprises a web 44. The mesh 42 is attached to the cup holder 30 and the cup holder 30 is positioned frontally on the surface of the first armrest 20. With the addition of components, the foldable lawn chair 12 serves as a dual purpose and can be used as a game playing device.

Figure 3:
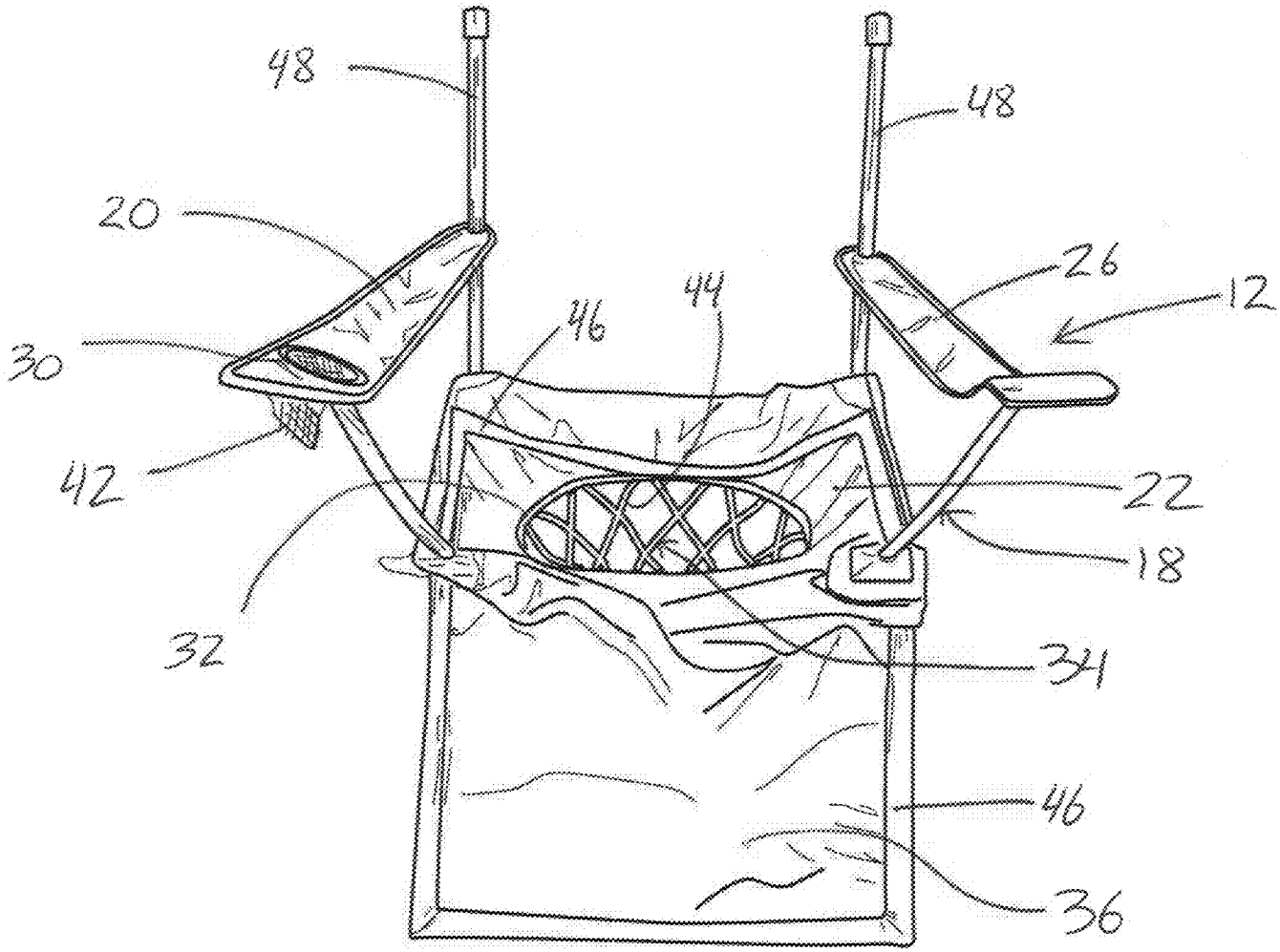
FIG. 3 is a front view of the device of the present disclosure, which includes a basketball net, an overlap flap, and a back support structure.
Figure 4:
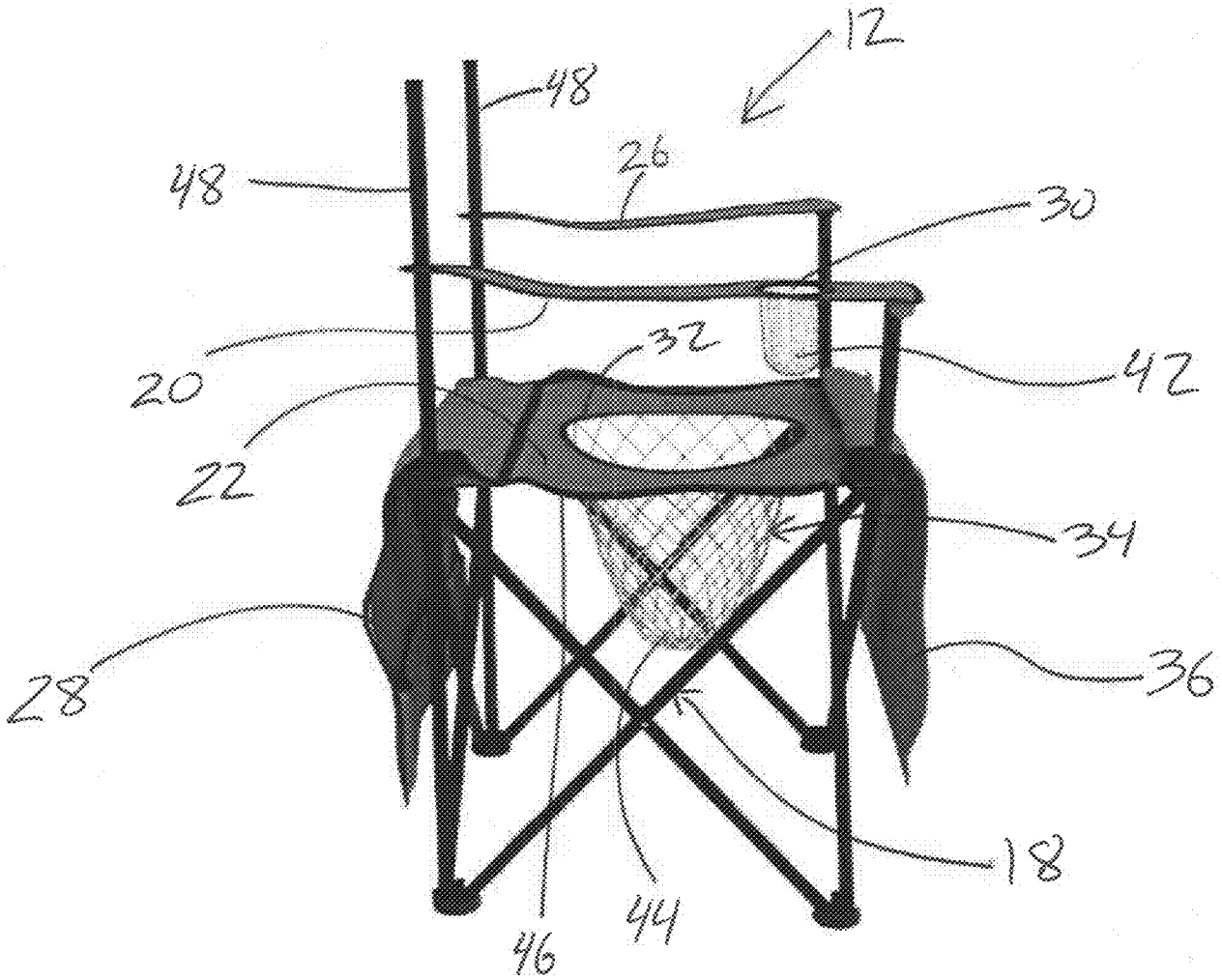
FIG. 4 is a side view of the device of the present disclosure, showing a cup holder, a foldable structure, and a basketball net.
Figure 5:
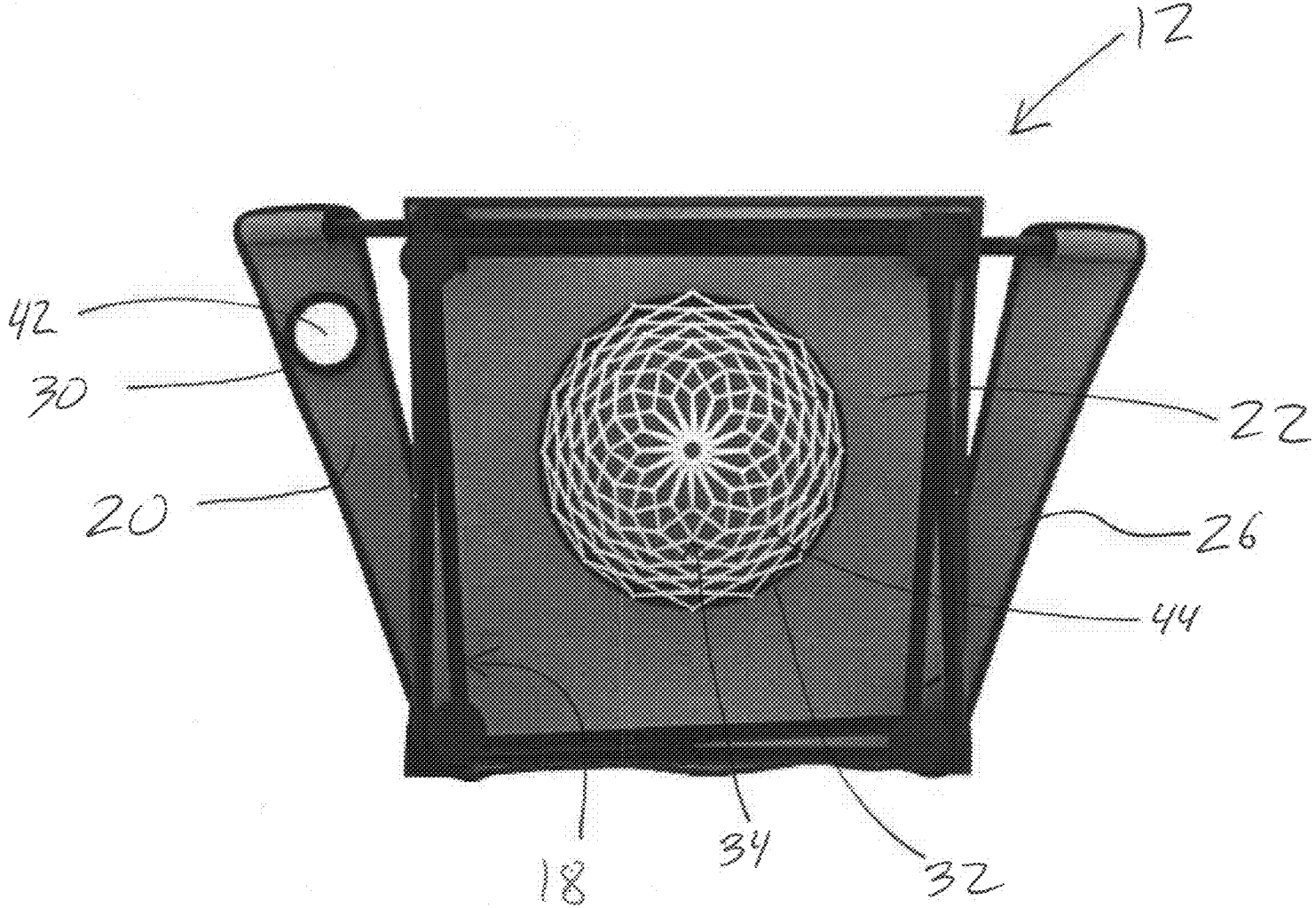
FIG. 5 is a top view of the device of the present disclosure, which shows a bottom canvas, the cup holder, the foldable structure, and the basketball net.

In reference to FIGS. 2-3, the basketball net 34 comprises a web 44 and a cover flap 36. The basketball net 34 is attached to the bottom part of the foldable lawn chair 12, and it is also positioned equidistantly from the edges. To ensure the basketball net 34 is secured in the appropriate position, the through hole 32 is positioned centrally on the bottom canvas 22 of the foldable lawn chair 12. The basketball net 34 can be sewn into the fabric of the foldable lawn chair 12, or otherwise attached. The web 44 of the basketball net 34 is also sewn shut to prevent the ball 16 from falling on the ground. The user is able to easily retrieve the ball 16 from the top of the lawn chair 12. The cover flap 36 is designed to preserve the seating function of the foldable lawn chair 12. During game play, the cover flap 36 is removed from the bottom part of the foldable lawn chair 12, to expose the basketball net 34 for use with the ball 16, as shown in FIGS. 4-5. If the user desires to sit down on the chair, the cover flap 36 can be easily installed, covering the basketball net 34 and providing a surface on which the user can sit. The cover flap attachment 46 can include, but is not limited to, hook and loop fasteners, a zipper, or other forms of attachment. The cover flap attachment 46 can be provided in a plurality of forms. The cover flap attachment 46 can be installed around the perimeter of the cover flap 36 or on all four corners, making the cover flap 36 fully removable. In another embodiment, the front edge of the cover flap 36 can be sewn permanently to the foldable lawn chair 12, allowing the cover flap 36 to be movable yet secured, reducing the chance for any potential misplacement.

In reference to FIG. 2, the field goal post 24 comprises a plurality of tubes 38 and a plurality of connection fittings 40. It is recommended that the components of the field goal post 24 are manufactured out of polyvinyl chloride (PVC) or like materials, but is not limited to these materials. PVC would satisfy the required criteria of lightness, strength, and durability. The tubes 38 are positioned on top of a back canvas structure 48 of the lawn chair, in U-shape form. To facilitate a secure connection, the field goal post 24 structure is fastened via the plurality of connection fittings 40. The connection fittings 40 are slightly larger in diameter than the tubes 38. The tubes 38 are inserted into the connection fittings 40, and due to the tight tolerances between components, the field goal post 24 can be securely attach to the foldable lawn structure 18. The foldable structure 18 of the foldable lawn chair 12 remains intact, and no additional modifications are required. The plurality of connection fittings 40 facilitates the installation and removal of the field goal post 24. By making the field goal post 24 easily removable, the foldable lawn chair 12 remains portable and retains the foldable characteristics. The plurality of attachments is designed to fit into the lawn chair carrying case. When the present invention is in use, the back canvas 28 can be folded down to prevent the present invention from being knocked over in case a stray ball 16 hits the back canvas 28 with full force.

The games provided by the present disclosure can be played in a plurality of player configurations, such as one player versus one player, two players versus two players, etc. During gameplay, two of the foldable lawn chairs 12 can be provided and positioned to face opposing teams, with a distance of about 10 yards separating the chairs. A player can throw the ball 16 into the basketball net 34 of the chair 12 opposite from where the user is standing. Various point scoring rules could be used. For example, if the ball 16 is thrown and hits any part of the chair 12 on a fly, three points could be awarded. If the ball 16 goes into the basketball net 34, seven points could be awarded. Further, if the ball 16 enters the basketball net 34, there could be an opportunity to gain one more point by kicking the ball 16 through the field goal post 24. To prepare for the kick, the ball 16 should be positioned at midfield, while a teammate holds the ball 16 and the player kicks it. If the ball 16 goes through the field goal post 24, the player receives a point. If, in the process of kicking the extra point, if the player kicks the ball 16 and it enters the basketball net 34, the player or team could win the game regardless of score. Further, if a player throws the ball 16 and it hits the ground and then bounces into the basketball net 34, the player could receive two points. Conceivably any point and/or scoring scheme could be utilized.

To ensure a fair game, and to minimize any potentially advantages pertaining to weather, or uneven terrain, opposing players should change position when the leading team reaches the following point milestones: twelve points, twenty-four points, thirty-six points, and forty-eight points. First team to reach fifty-four points is declared the winner. If during the play, the ball 16 touches the chair 12 and the opposite team catches it before it touches the ground, the opposing team could be awarded three points. Any variations or game rules could be utilized.

Figure 6:
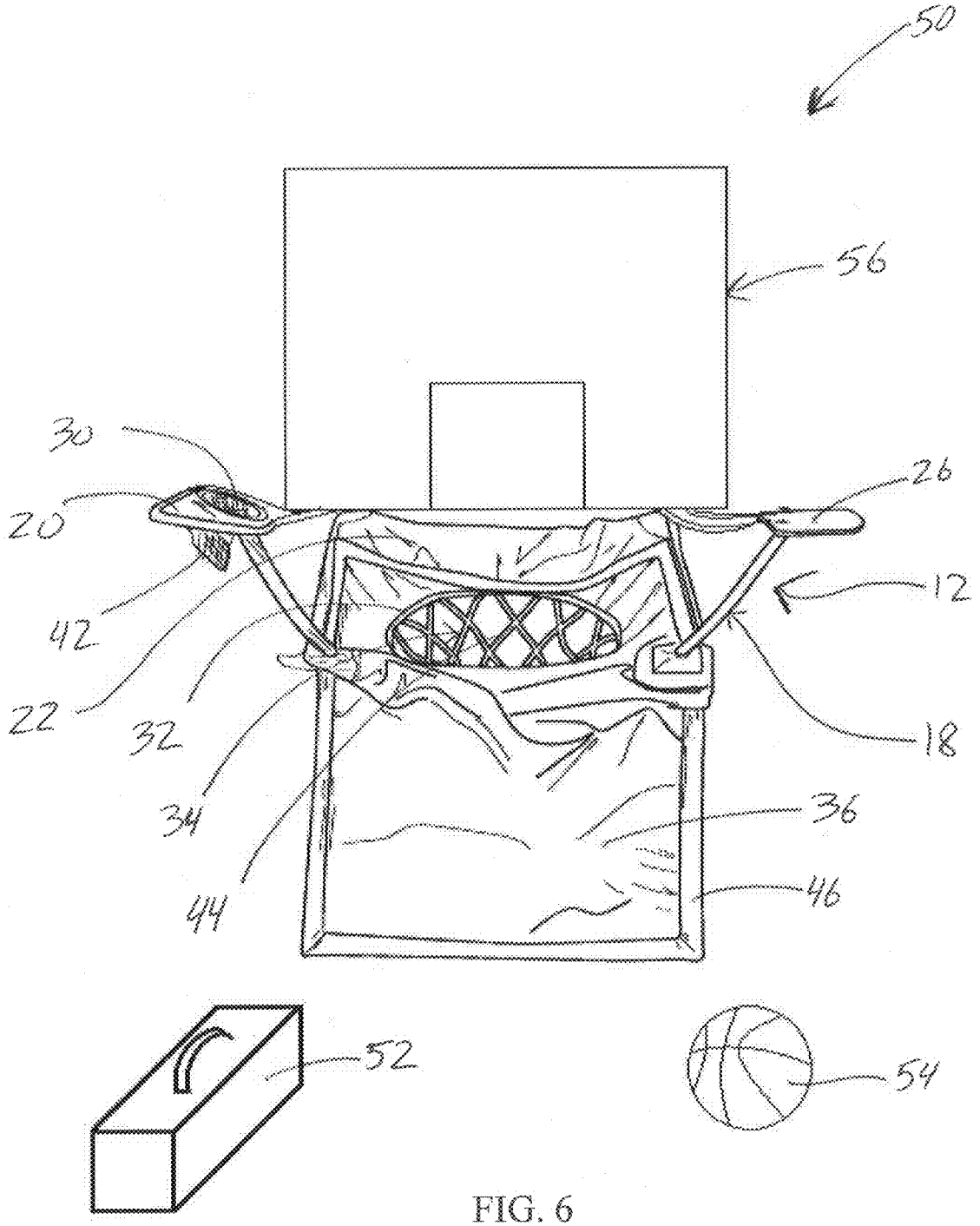
FIG. 6 is a front perspective view of another embodiment of the device.
Figure 7:
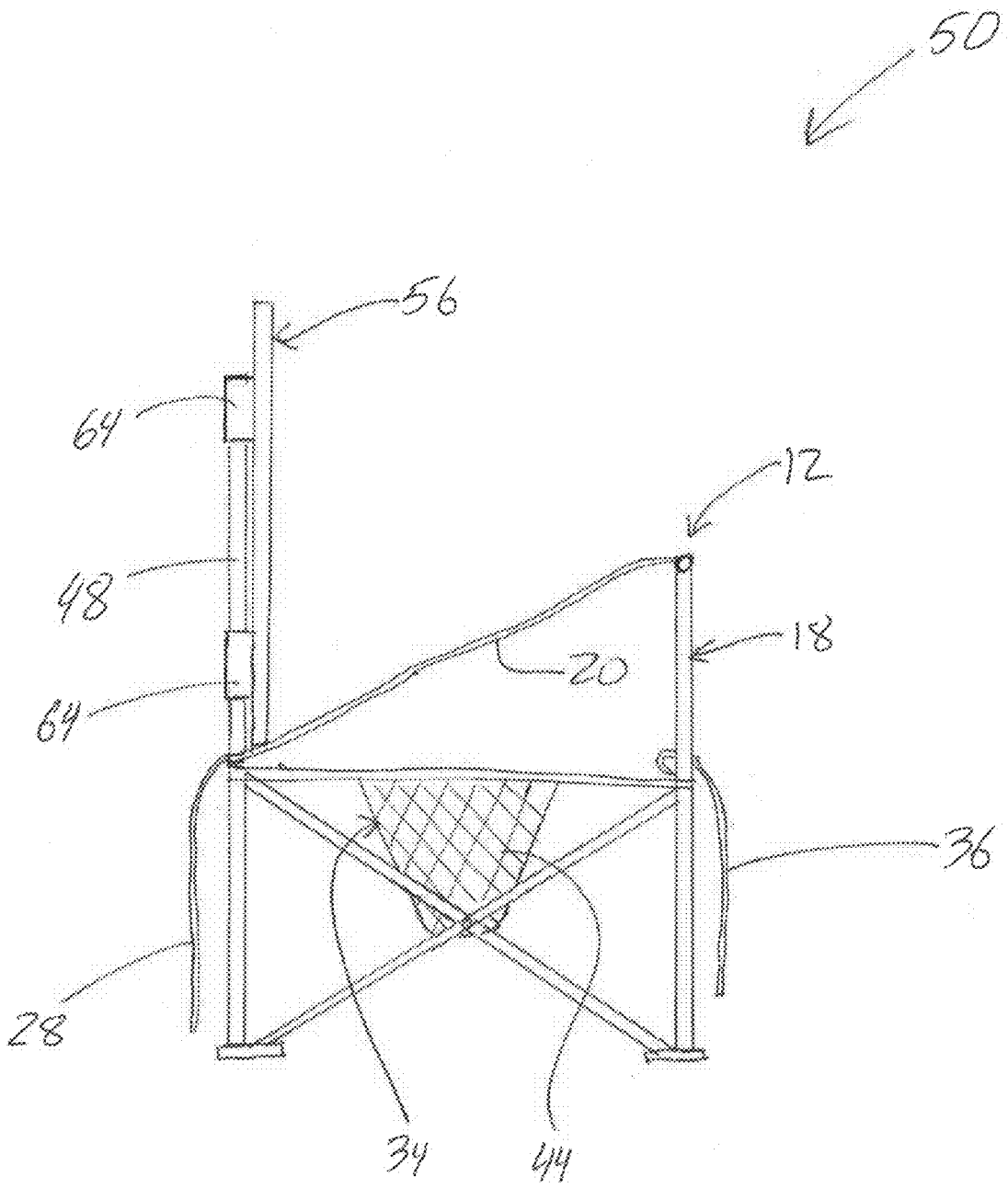
FIG. 7 is a side view of the device of FIG. 6.
Figure 8:
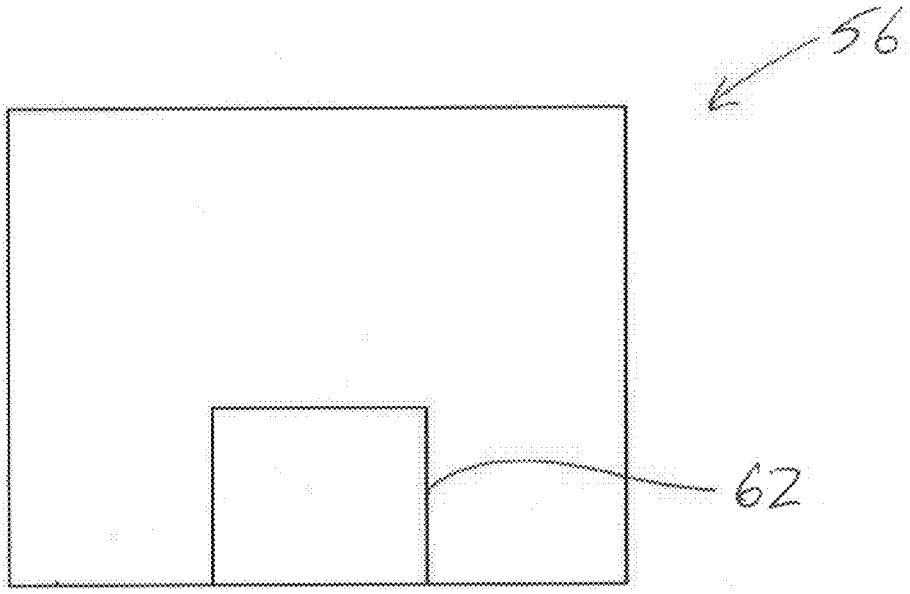
FIG. 8 is a front view of a backboard of the device of FIG. 6.
Figure 9:
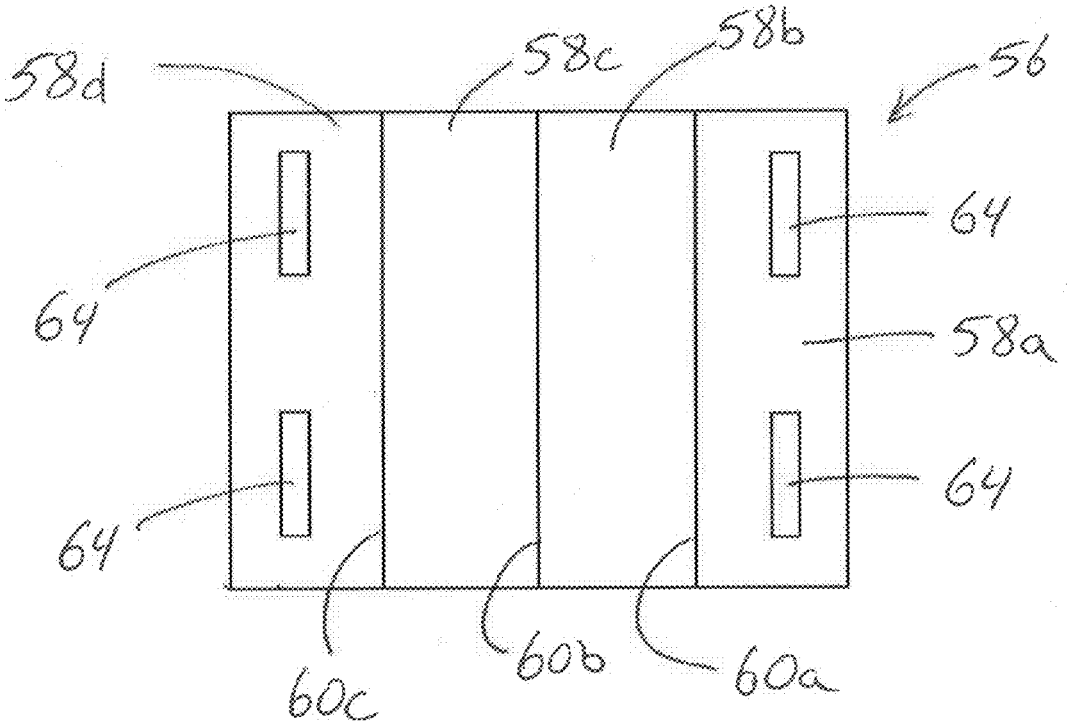
FIG. 9 is a rear view of the backboard of FIG. 8.

FIGS. 6-9 show another embodiment of the device, indicated at 50. FIGS. 6 and 7 are respectively front perspective and side views of the device 50. The device 50 includes the foldable lawn chair 12 (as described above in connection with FIGS. 1-5), a carrying case 52, a ball 54, and a foldable backboard 56. FIGS. 8 and 9 are, respectively, front and rear views of the backboard 56. The backboard 56 is generally square or rectangular in shape and includes four sections 58*a*, 58*b*, 58*c*, 58*d* that are connected by three hinged seams 60*a*, 60*b*, 60*c*. The hinged seams 60*a*, 60*b*, 60*c* allow the backboard 56 to be folded from a first flat configuration into a second collapsed configuration with the four sections 58*a*, 58*b*, 58*c*, 58*d* overlapping. This allows the backboard 56 to be collapsed so that it can fit into the carrying case 52, but also retains the backboard 56 as a single component. In some aspects, the backboard 56 can include latches to maintain the backboard 56 in the flat configuration. In some aspects, the backboard 56 can be 16" in width and 16" in height, through other dimensions are contemplated.

The front of the backboard 56 can include indicia 62 that provides the appearance of a standard basketball backboard. The rear of the backboard 56 can include a plurality of tubes 64 that are sized to receive the back canvas structure 48 of the foldable lawn chair 12. To install the backboard 56 on the foldable lawn chair 12, a user simply unfolds the backboard 56 and inserts the back canvas structure 48 of the foldable lawn chair 12 into the tubes 64, thus securing the backboard 56 to the foldable lawn chair 12. Users can then throw the ball 54 into the basketball net 34 of the foldable lawn chair 12 using the backboard 56 to deflect that ball 54 into the basketball net 34, e.g., a "bank" shot. Scoring when using the game playing device 50 can be based on whether a user hits the backboard 56 with the ball 54 in order for the ball 54 to enter the basketball net 34. For example, if a user causes the ball 54 to go into the basketball net 34 without hitting the backboard 56, 3 points could be awarded. If the user causes the ball 54 to go into the basketball net 34 after hitting the backboard 56, then only 2 points could be awarded. The backboard 56 and the foldable lawn chair 12 can be secured in the carrying case 52 for easy transportation.

The backboard 56 can also be an add-on to the game playing device 10 described in connection with FIGS. 1-5. Specifically, a user who already owns the game playing device 10 can purchase the backboard 56 separately and implement it with an existing foldable chair. This allows a user to alternate between utilizing the field goal 24 and the backboard 56.

Figure 10:
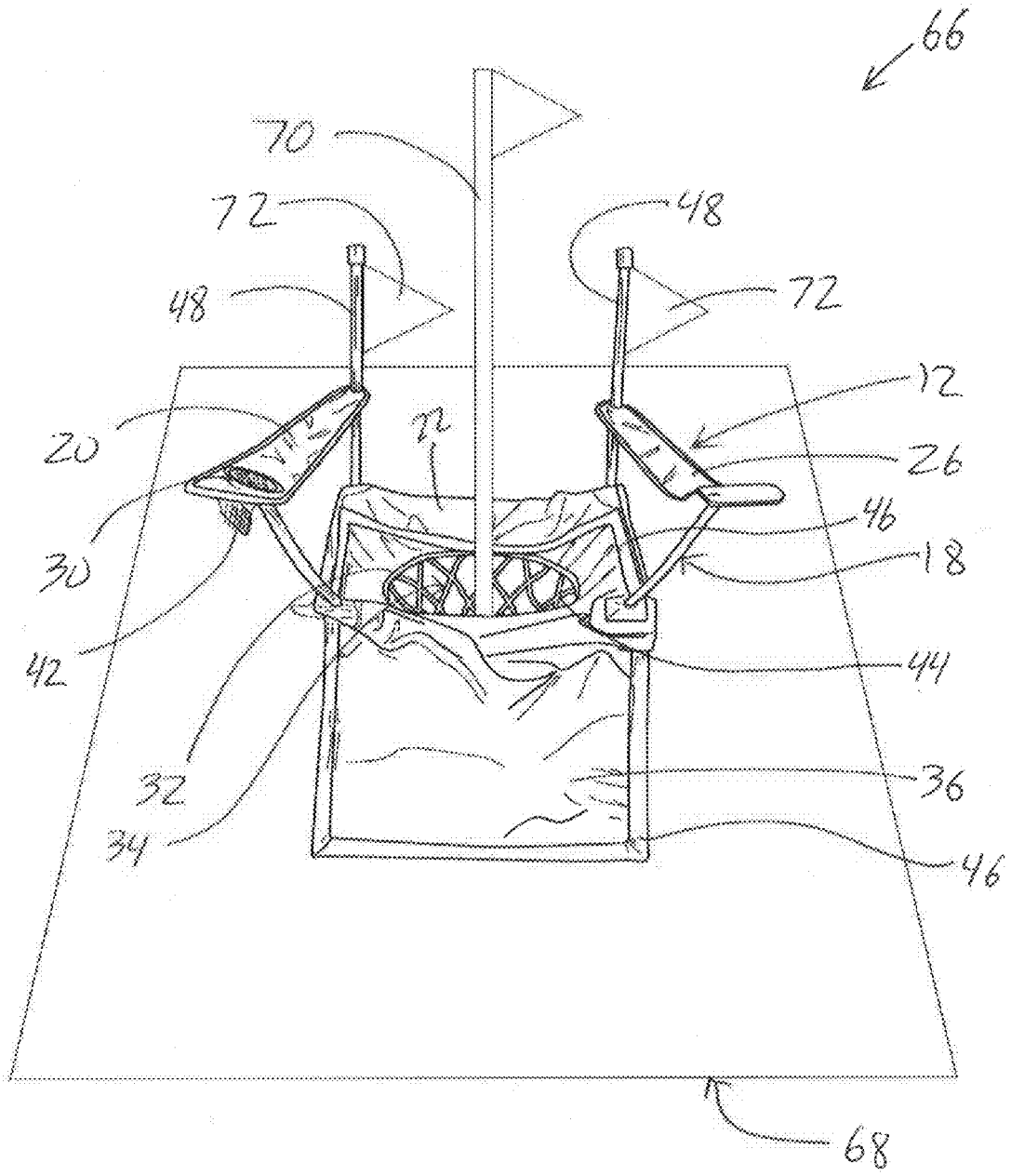
FIG. 10 is a front perspective view of another embodiment device.
Figure 11:
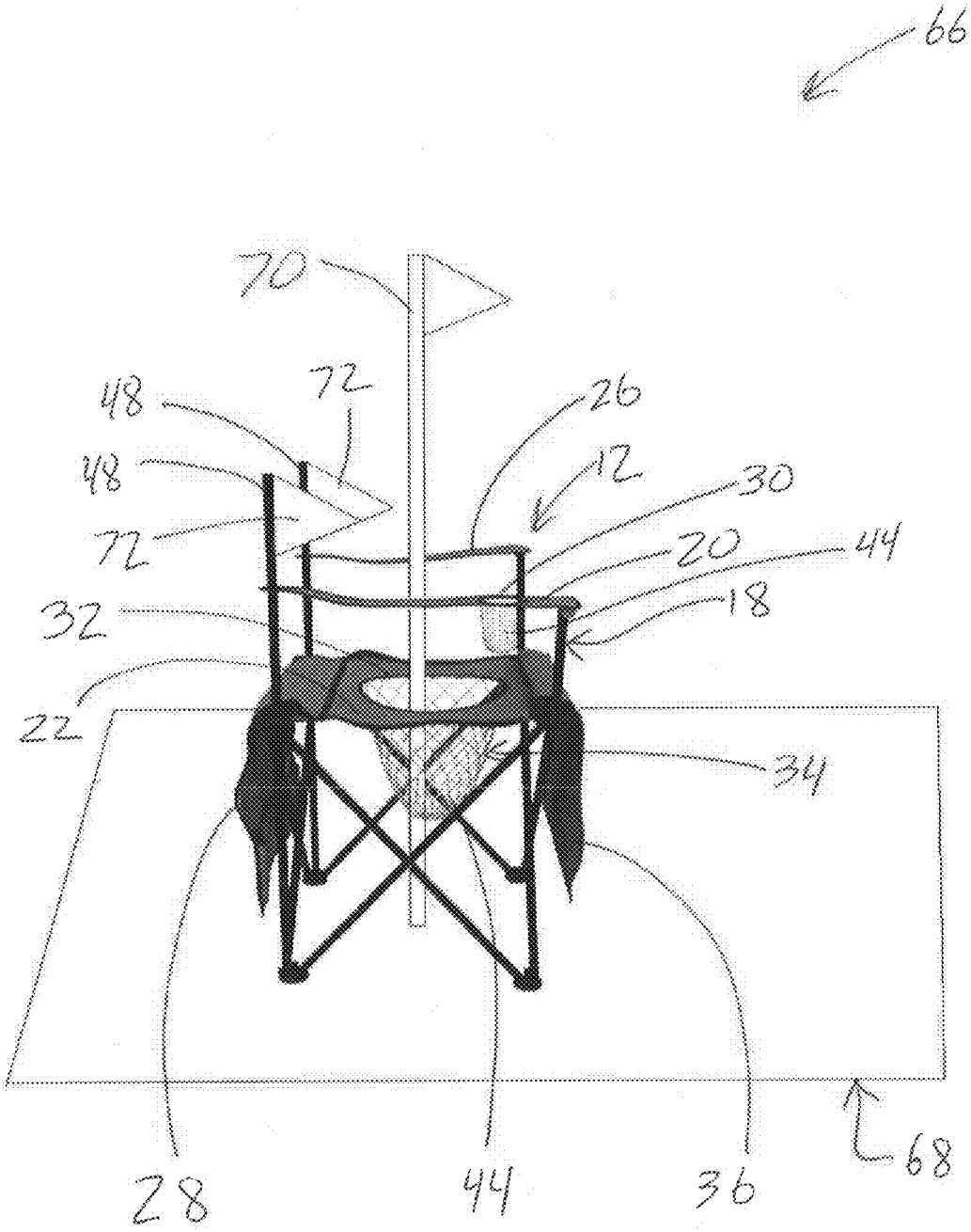
FIG. 11 is a side view of the device of FIG. 10.

FIGS. 10 and 11 are, respectively, front perspective and side views of another embodiment game playing device 66. The game playing device 66 includes the foldable lawn chair 12 (as described above in connection with FIGS. 1-5), a game mat 68, and a flag pole 70. The game mat 68 can be a padded mat that has the appearance of grass. The game mat 68 can be placed on the ground with the foldable lawn chair 12 placed on top of it. The flag pole 70 can then be placed through the through hole 32 and the basketball net 34 of the foldable lawn chair 12 and secured to the game mat 68. The game playing device 66 can also include ornamental flags 72 secured to the foldable lawn chair 12. In some aspects, the flag pole 70 can be 6 feet in height, though other dimensions are contemplated. The game playing device 66 can be utilized whereby a user hits a ball with a club to attempt to get the ball into the basketball net 34. The game mat 68 and flag pole 70 can also be an add-on to the game playing device 10 described in connection with FIGS. 1-5. Specifically, a user who already owns the game playing device 10 can purchase the game mat 68 and flag pole 70 separately and implement it with an existing foldable chair. This allows a user to alternate between utilizing the field goal 24, and the game mat 68 and flag pole 70.

Having thus described the invention in detail, it is to be understood that the foregoing description is not intended to limit the spirit or scope thereof. It will be understood that the embodiments of the present invention described herein are merely exemplary and that a person skilled in the art may make any variations and modification without departing from the spirit and scope of the invention. All such variations and modifications, including those discussed above, are intended to be included within the scope of the invention. What is desired to be protected by Letters Patent is set forth in the following claims.

What is claimed is:

1. A game playing device, comprising:

a foldable chair, the foldable chair comprising:

a foldable structure having a back canvas structure, a bottom canvas secured to the foldable structure, the bottom canvas having a through-hole, a cover flap removably connected to the bottom canvas and covering the through-hole, and a back canvas removably secured to the back canvas structure; and a field goal including a plurality of pipes and a plurality of connection fittings, the plurality of pipes connected with the plurality of connection fittings;

wherein the back canvas can be removed from the back canvas structure and the field goal can be removably connected to the back canvas structure when the back canvas is removed from the back canvas structure, and wherein the cover flap can be moved from a first position covering the through-hole and allowing a user to sit on the foldable chair, and a second position where the cover flap is at least partially removed from the bottom canvas to expose the through-hole.

2. The game playing device of claim 1, further comprising a net secured about the perimeter of the through-hole.

3. The game playing device of claim 1, further comprising a ball configured to be inserted into the through-hole.

4. The game playing device of claim 1, further comprising a carrying case that is configured to receive the foldable chair and the field goal.

5. The game playing device of claim 1, further comprising a first arm rest secured to the foldable structure and a second arm rest secured to the foldable structure.

6. The game playing device of claim 5, wherein the first arm rest includes a cup holder.

7. The game playing device of claim 1, further comprising a means for removably attaching the cover flap to the bottom canvas.

8. The game playing device of claim 7, wherein the means for removably attaching is a hook and loop fastener.

9. The game playing device of claim 7, wherein the means for removably attaching is a zipper.

10. The game playing device of claim 1, wherein at least a portion of the cover flap is permanently secured to the bottom canvas.

11. A kit for a game playing device, comprising:

a foldable chair, the foldable chair comprising:

a foldable structure having a back canvas structure, a bottom canvas secured to the foldable structure, the bottom canvas having a through-hole, a cover flap removably connected to the bottom canvas and covering the through-hole, and a back canvas removably secured to the back canvas structure; and a field goal including a plurality of pipes and a plurality of connection fittings, the plurality of pipes being connectable with the plurality of connection fittings;

wherein the back canvas is removable from the back canvas structure and the field goal is connectable to the back canvas structure when the back canvas is removed from the back canvas structure, and wherein the cover flap is movable from a first position covering the through-hole and allowing a user to sit on the foldable chair, and a second position where the cover flap is at least partially removed from the bottom canvas to expose the through-hole.

12. The kit for a game playing device of claim 11, further comprising a net secured about the perimeter of the through-hole.

13. The kit for a game playing device of claim 11, further comprising a ball configured to be inserted into the through-hole.

14. The kit for a game playing device of claim 11, further comprising a carrying case that is configured to receive the foldable chair and the field goal.

15. The kit for a game playing device of claim 11, further comprising a first arm rest secured to the foldable structure and a second arm rest secured to the foldable structure.

16. The kit for a game playing device of claim 15, wherein the first arm rest includes a cup holder.

17. The kit for a game playing device of claim 11, further comprising a means for removably attaching the cover flap to the bottom canvas.

18. The kit for a game playing device of claim 17, wherein the means for removably attaching is a hook and loop fastener.

19. The kit for a game playing device of claim 17, wherein the means for removably attaching is a zipper.

20. The kit for a game playing device of claim 11, wherein at least a portion of the cover flap is permanently secured to the bottom canvas.

21. A game playing device, comprising:

a foldable chair, the foldable chair comprising:

a foldable structure having a back canvas structure, a bottom canvas secured to the foldable structure, the bottom canvas having a through-hole, a cover flap removably connected to the bottom canvas and covering the through-hole, and a back canvas removably secured to the back canvas structure; and a backboard;

wherein the back canvas can be removed from the back canvas structure and the backboard can be removably connected to the back canvas structure when the back canvas is removed from the back canvas structure, and wherein the cover flap can be moved from a first position covering the through-hole and allowing a user to sit on the foldable chair, and a second position where the cover flap is at least partially removed from the bottom canvas to expose the through-hole.

22. The game playing device of claim 21, further comprising a net secured about the perimeter of the through-hole.

23. The game playing device of claim 21, further comprising a ball configured to be inserted into the through-hole.

24. The game playing device of claim 21, wherein the backboard comprises four sections connected by three hinged seams, the backboard being foldable into a collapsed configuration.

25. The game playing device of claim 24, further comprising a carrying case that is configured to receive the foldable chair and the backboard when the backboard is in the collapsed configuration.

26. The game playing device of claim 21, further comprising a means for removably attaching the cover flap to the bottom canvas.

27. A game playing device, comprising:

a foldable chair, the foldable chair comprising:

a foldable structure having a back canvas structure, a bottom canvas secured to the foldable structure, the bottom canvas having a through-hole, a cover flap removably connected to the bottom canvas and covering the through-hole, and a back canvas removably secured to the back canvas structure;

a game mat; and a pole, wherein the foldable chair can be positioned on the game mat, and wherein the cover flap can be moved from a first position covering the through-hole and allowing a user to sit on the foldable chair, and a second position where the cover flap is at least partially removed from the bottom canvas to expose the through-hole and permit the pole to be inserted into the through-hole and secured to the game mat.

28. The game playing device of claim 27, further comprising a net secured about the perimeter of the through-hole.

29. The game playing device of claim 27, further comprising a means for removably attaching the cover flap to the bottom canvas.

* * * * *